United States Patent [19]

Schaub et al.

[11] 4,110,071

[45] Aug. 29, 1978

[54] PROCESS FOR THE TONE-IN-TONE PRINTING AND PAD-DYEING OF TEXTILE MATERIAL MADE FROM FIBRE MIXTURES

[75] Inventors: Andres Schaub, Biel-Benken; Gerhard Kögel, Reinach, both of Switzerland

[73] Assignee: Ciba-Geigy AG, Basel, Switzerland

[21] Appl. No.: 689,986

[22] Filed: May 26, 1976

[30] Foreign Application Priority Data

May 26, 1975 [CH] Switzerland ..... 6715/75

[51] Int. Cl.[2] ..... D06P 3/82

[52] U.S. Cl. ..... 8/21 R; 8/21 B; 8/21 C; 8/22; 8/41 B; 8/41 C; 8/44; 8/45; 8/54.2; 8/93

[58] Field of Search ..... 8/21 C, 44, 45, 21 R, 8/21 B, 22, 41 B, 41 C, 54.2, 93

[56] References Cited

U.S. PATENT DOCUMENTS

| | | | |
|---|---|---|---|
| 3,266,863 | 8/1966 | Price | 8/44 |
| 3,288,552 | 11/1966 | Streck | 8/44 |
| 3,617,180 | 11/1971 | Streck | 8/45 |
| 3,658,456 | 4/1972 | Hertel | 8/44 |
| 3,667,897 | 6/1972 | Blackwell et al. | 8/21 C |
| 3,706,525 | 12/1972 | Blackwell et al. | 8/21 C |
| 3,888,624 | 6/1975 | Blackwell et al. | 8/21 C |
| 4,017,256 | 4/1977 | Kogel et al. | 8/21 C |

FOREIGN PATENT DOCUMENTS 1,437,204 5/1976 United Kingdom.

*Primary Examiner*—A. Lionel Clingman
*Attorney, Agent, or Firm*—Wenderoth, Lind & Ponack

[57] ABSTRACT

Described is a process for the tone-in-tone printing and pad-dyeing of textile material made from fibre mixtures of synthetic and natural material with at least one disperse dye with the use of solvents having swelling properties, which process comprises printing or impregnating the textile material with a printing paste or padding liquor in which one or more disperse dyes have been produced by reaction of coupling components with diazo components; subsequently subjecting the printing or the dyeing, after intermediate drying, to a heat treatment and finally to the finishing process.

There are obtained in the case of many disperse dyes when they are produced in the printing paste or padding liquor by the process of the invention better fixings on the natural constituent of the mixed fibres than when the same dyes are firstly produced and then added in the finely-dispersed form to the printing paste or padding liquor.

19 Claims, No Drawings

PROCESS FOR THE TONE-IN-TONE PRINTING AND PAD-DYEING OF TEXTILE MATERIAL MADE FROM FIBRE MIXTURES

The present invention relates to a process for the tone-in-tone printing and pad-dyeing of textile material made from fibre mixtures of synthetic and natural material, to the production of the printing paste or padding liquor used for the purpose, to the printing paste or padding liquor as such, as well as to the textile material printed or dyed by this process.

If mixed fibres made from synthetic and natural material are dyed with disperse dyes, the natural material does not become dyed — it becomes at most stained — whilst in the case of dyeing with dyes well suited for dyeing the natural material, such as reactive or direct dyes, only an inadequate dyeing of the synthetic material is obtained.

For the coloured printing of mixed fibres, therefore, there is customarily used a printing paste containing a dye mixture of the respective dyes suitable for the individual constituents of the mixed fibres, whereby, however, the constituents of the mixed fibres can only rarely be dyed in exactly the same shade.

The U.S. Pat. No. 3,266,863 describes a process for printing mixed fabrics of polyester and cotton using printing pastes which contain, in addition to an alkanolamine and the constituents required to form the disperse dye, optionally reactive dyes and finished disperse dyes. The coupling reaction of the constituents occurs on the fibres, since the diazo compound has been stabilised and cannot react until being heated with the coupling component.

From the Canadian Patent No. 832,343 there is known a process for printing mixed fibres of cellulose and synthetic material, in which process both constituents of the mixed fibres are dyed with the same pre-dispersed dye, whereby there is used a printing paste which contains solvents having swelling properties.

This process, however, can only be performed with special disperse dyes. Moreover, the unfixed disperse dye that has become detached in the scouring bath can be prevented from becoming re-absorbed onto the white ground (unprinted areas) only by careful control of the scouring process and by the use of special auxiliaries.

For the pad-dyeing and printing of textile material made from fibre mixtures, there has now been found a process which does not have the above-mentioned disadvantages. This novel process is characterised in that the dyes used are not finished, finely-dispersed disperse dyes, but disperse dyes that are produced actually in the printing paste or padding liquor itself.

Surprisingly, there are obtained in the case of many disperse dyes when they are produced in the printing paste or padding liquor by the process of the invention better fixings on the natural constituent of the mixed fibres than when the same dyes are firstly produced and then added in the finely-dispersed form to the printing paste or padding liquor.

Whereas therefore the process of the Canadian Patent No. 832,343 is limited to special disperse dyes, the process according to the invention renders possible the use of a large number of other dyes.

Furthermore, the unfixed, washed-out part of the disperse dye produced in the printing paste or padding liquor surprisingly has virtually no tendency, even without the use of special auxiliaries, to be re-absorbed from the scouring water onto the material. The white ground does not therefore become stained.

The present invention thus relates to a process for the tone-in-tone printing and pad-dyeing of textile material from fibre mixtures of synthetic and natural material with at least one disperse dye with the use of solvents having swelling properties, which process comprises printing or impregnating the textile material with a printing paste or padding liquor in which one or more disperse dyes have been produced by reaction of coupling components with diazo components; subsequently subjecting the printing or the dyeing, after intermediate drying, to a heat treatment and finally to the finishing process.

Textile material made from fibre mixtures of natural and synthetic organic material can be dyed by the process of the invention, whereby suitable natural material is, in particular, cellulose material made from natural and regenerated cellulose, such as hemp, linen, jute, viscose silk, spun rayon or especially cotton.

Suitable synthetic organic materials are, e.g.: fibre materials made from synthetic polyamide such as condensation products from hexamethylenediamine and adipic acid (polyamide 6.6) or sebacic acid (polyamide 6.10); also mixed condensation products, e.g. from hexamethylenediamine, adipic acid and ε-caprolactam (polyamide 6.6/6); besides polymerisation products from ε-caprolactam or from ω-aminoundecanoic acid. Also suitable is polyester material, e.g. linear high-molecular esters of aromatic polycarboxylic acids with polyfunctional alcohols, e.g. those from terephthalic acid and ethylene glycol or dimethylolcyclohexane, as well as mixed polymers from terephthalic acid and isophthalic acid and ethylene glycol. And finally also cellulose (2 ½)-acetate fibres and cellulose triacetate fibres are suitable as synthetic fibre material.

The textile material preferably dyed or printed by the process according to the invention is that made from fibre mixtures consisting of two constituents, especially fibre mixtures of polyester and cotton; it is also possible, however, to use fibre mixtures containing three or more of the aforementioned fibre materials.

The textile material can for example be in the form of fabric, looped fabric such as knitwear or knitted fabrics, or fleece.

A printing paste or padding liquor suitable for the process according to the invention is obtained by a process wherein a coupling component is mixed, e.g. in the presence of alkalies, with a pasting agent such as alcohol or Turkey red oil; this mixture is dissolved in water at a temperature of about 10° C. to 40° C., particularly at 15° C. to 25° C., a thickening agent is added, advantageously an anionic or nonionic dispersing agent is then introduced; and finally the diazo component, e.g. in the form of a stabilised colour salt or diazotised colour base, is added as well as a solvent having swelling properties. In the printing paste or padding liquor produced in this manner, the formation of the disperse dye occurs as a result of the reaction of the coupling component with the diazo component. The solvent having swelling properties can be added to the printing paste or padding liquor at any point of time; for example it can be added at the commencement of the production process as an aqueous solution.

The coupling components to be used can be of varying nature. Suitable compounds are those usable for the production of azo dyes, for example acetoacetic acid amides and acetoacetic acid arylides, hydroxyquinolines, pyrazoles, phenols, naphthols, particularly however amino- and/or hydroxynapththalenes or N-alkyl, N-aryl or N-acyl derivatives thereof, and especially hydroxynaphthoic acid arylamides. Also suitable are amines of the benzene or naphthalene series, coupling in the p-position. Suitable compounds are given, for example, in the Colour Index, 3rd Edition, Vol. 1, published by THE SOCIETY OF DYERS AND COLOURISTS (1971) under the designation "Azoic Coupling Components". Also heterocyclic coupling components can be used in the process of the invention, e.g. those described in the German 'Offenlegungsschrift' No. 2,231,245, particularly the hydroxypyridones listed therein The diazo components to be used are known. Suitable as such are the compounds generally used for producing azo dyestuffs, such as diazotised substituted anilines, naphthylamines, diphenylamines, heteroaromatic amines or diamines of the formula $H_2N$-A-$NH_2$, whereby A can represent the phenylene, naphthylene or diphenyl group, or a group of the formula

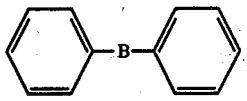

wherein B can be oxygen, sulphur, —NH—, —$SO_2$—, —N=N—, —CH=CH—, —NHCO— or —NH—CO—NH—. Suitable substituents are, in particular, methyl, chloro, nitro, methoxy, ethoxy, phenoxy, hydroxy, carboxy, carbalkoxy and carboxylic acid amide groups.

Suitable compounds are, for example, the azoic diazo compounds given in the aforementioned Colour Index.

Preferably, only one coupling component and one diazo component are used in the process according to the invention; it is however also possible to use mixtures of several coupling components and diazo components, so that dyeings in mixed shades are obtained.

Suitable thickening agents are those generally used in textile printing, such as types of gum, tragacanth, starch ether and carob bean flour derivatives.

The preferably anionic or nonionic dispersing agents which can be added to the printing paste or padding liquor serve in particular to effect a good fine-dispersion of the disperse dyes, and hence to render possible the attainment of better fastness to rubbing. The dispersing agents customarily used in dyeing with disperse dyes can be used.

Suitable solvents having swelling properties are glycols or glycol derivatives, e.g. those given in the Canadian Patent No. 832,343, especially polyglycols, such as polyethylene glycol.

These solvents having swelling properties are added to the printing paste or padding liquor in amounts of 10 to 200 g/kg, preferably 50 to 150 g/kg, of printing paste or padding liquor.

The mixed fabric is printed or padded with the printing paste or padding liquor obtained according to the invention in the known manner and subsequently dried. The dyes are afterwards fixed on the mixed fabric, for example by heating for 30 to 120 seconds at 190° C. to 230° C., preferably for 60 seconds at 210°–220° C., or by steaming, e.g. at normal pressure with superheated steam at 170° C. to 200° C., for 3 to 12 minutes, preferably 5 to 8 minutes, or with steam at 1.5 bars excess pressure for 15 to 30 minutes.

After fixing, the material is finished in the known manner.

There are obtained by this process with use of the printing pastes or padding liquors printings or dyeings which have the advantages mentioned at the beginning, particularly a very level tone-in-tone effect.

The invention is illustrated by the following Examples without being limited by them. The quantity values relate in the case of the coupling components to the substance alone (techn. products); in the case of the diazo components they relate to the commercial, i.e., diluted, product. Percentages are given as percent by weight and the temperatures in degrees Centigrade.

EXAMPLE 1

A. Production of the printing paste 5 g of the coupling component of the formula

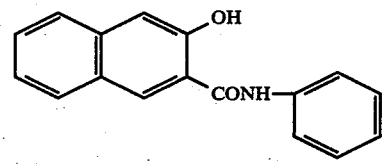

is stirred to a paste with 5 g of sulphonated castor oil (Turkey red oil) and 5 g of NaOH 36° Be, and the paste is dissolved in 187 g of boiling water. By the addition of 500 g of a 4% aqueous solution of carboxymethylated locust bean flour, the solution obtained is thickened to a viscosity of 6,000–10,000 cP. There is then added 30 g of a fatty alcohol oxyethylation product (addition product of 18 moles of ethylene oxide with a mixture of alcohols having 11 to 18 carbon atoms). There is finally added, with stirring, a solution of 18 g of stabilised diazo salt of the amine of the formula

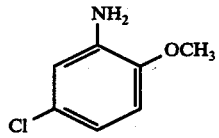

in 150 g of water, and coupling is effected. An addition is subsequently made of 100 g of polyethylene glycol (mol. weight about 400).

B. Application of the printing paste

A mixed fabric ready for printing, consisting of 67% of polyester and 33% of cotton, is printed in the screen-printing process with the printing paste produced according to A); the fabric is dried and subsequently thermofixed for 1 minute at 220°. The unfixed parts of the dye are removed by scouring with cold water and with boiling water. There is obtained a very level tone-in-tone red-printed mixed fabric, with the printing having good fastness properties by virtue of the ease with which the unfixed dye can be washed out.

EXAMPLES 2 to 25

If there is used, instead of the printing paste employed in Example 1, a paste containing 5g/kg of the coupling component given in Column 2 of the following Table I, as well as the diazonium salt of the amine listed in Column 3 in the amount shown in Column 4, with the procedure otherwise being exactly as described in Example 1, then there are obtained mixed fabrics dyed very evenly tone-in-tone in the shades given in Column 5.

Table I

| Example | Coupling component | Amine | Amount [g/kg] | Shade on polyester cotton |
|---|---|---|---|---|
| 2 | Coupling component from Example 1 | 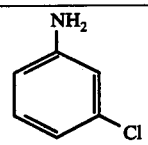 | 20 | orange |
| 3 | " | 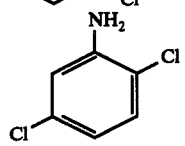 | 18 | scarlet |
| 4 | " | 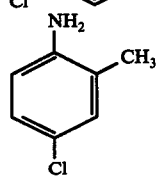 | 22 | red |
| 5 | " | 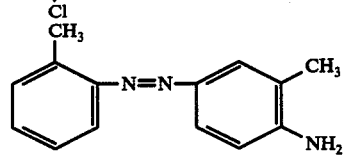 | 31 | Bordeaux red |
| 6 | " | 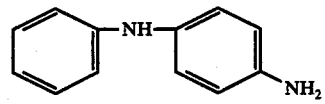 | 26 | navy blue |
| 7 | " | 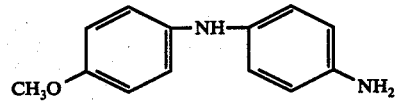 | 26 | royal blue |
| 8 | 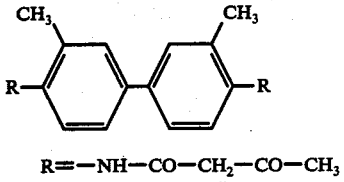 | 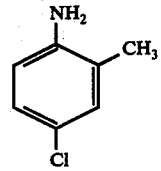 | 26 | lemon yellow |
| 9 | " | 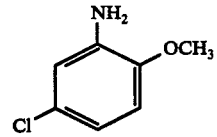 | 28 | yellow |
| 10 | " | 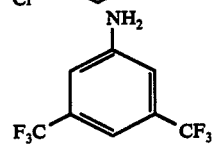 | 28 | yellow |
| 11 | " | 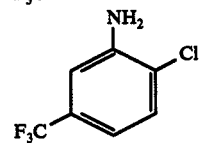 | 26 | gold-yellow |
| 12 | 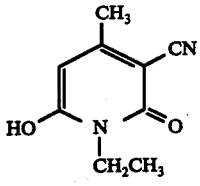 | 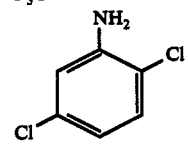 | 20 | yellow |

Table I-continued
| Example | Coupling component | Amine | Amount [g/kg] | Shade on polyester cotton |
|---|---|---|---|---|
| 13 | 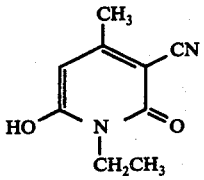 | 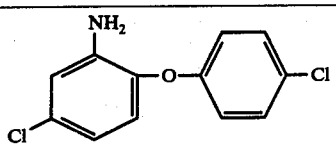 | 26 | gold-yellow |
| 14 | " | 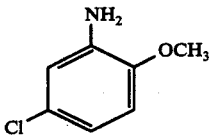 | 20 | orange |
| 15 | " | 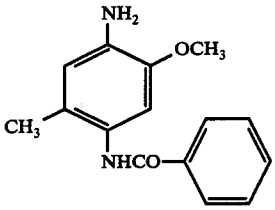 | 30 | rust-red |
| 16 | " | 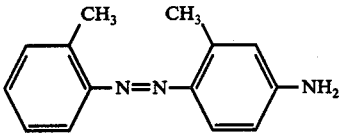 | 30 | red |
| 17 | " | 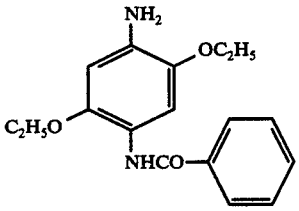 | 30 | violet |
| 18 | 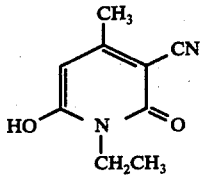 | 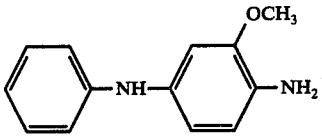 | 25 | blue |
| 19 | 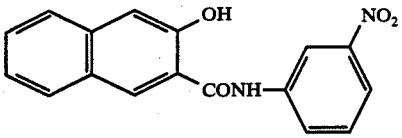 | 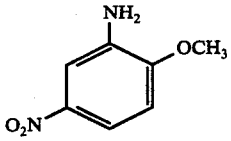 | 30 | red |
| 20 | 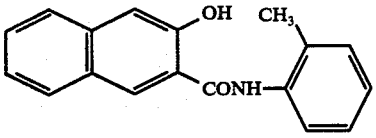 | 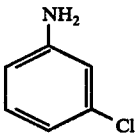 | 25 | reddish-orange |
| 21 | 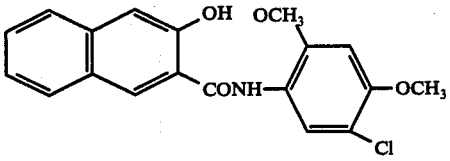 | 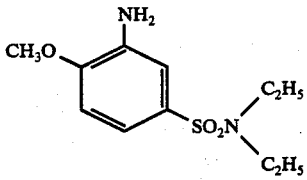 | 20 | bluish-red |
| 22 | 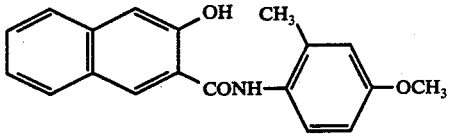 | 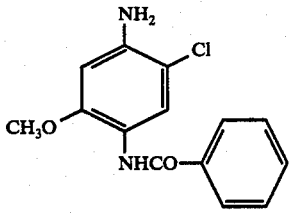 | 25 | violet |

Table I-continued

| Example | Coupling component | Amine | Amount [g/kg] | Shade on polyester cotton |
|---|---|---|---|---|
| 23 | 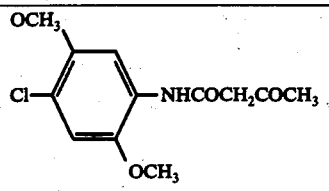 | 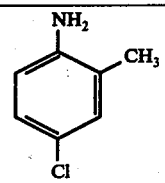 | 25 | greenish-yellow |
| 24 | 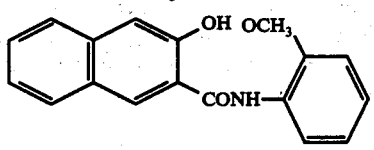 | 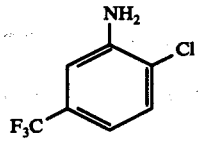 | 15 | reddish-orange |
| 25 | 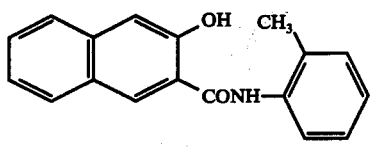 | 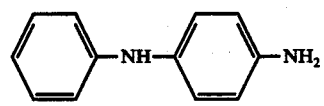 | 25 | black |

If the mixed fabric after drying is not thermofixed for 1 minute at 220° C. but treated for 8 minutes at 190° C. with superheated steam, or for 20 minutes with pressurised steam (1.5 bars excess pressure), with otherwise the same procedure, then analogous printings having equally good fastness properties are obtained.

In the case where printing pastes containing the corresponding disperse dye in the commercial form are used, with the procedure being otherwise as described, then there are obtained printings which are less fast to wet processing and on which in the course of the scouring process the white ground becomes more stained.

EXAMPLE 26

If a padding liquor is prepared by proceeding as in Example 1 but using, instead of 600 g of sodium alginate thickening, 150 g of the same thickening and 450 g of water, and if a mixed fabric composed of 50% of polyester and 50% of cotton is impregnated on a padding machine with this liquor, so that the liquor take-up is about 100%, dried and subsequently thermofixed for 1 minute at 200° C. and scoured as in Example 1, then a mixed fabric dyed tone-in-tone is obtained, which fabric possesses, by virtue of the ease with which the unfixed dye can be washed out, good fastness properties.

EXAMPLE 27

Instead of the printing paste described in Example 1, there is produced the following printing paste:

5 g of the coupling component from Example 1 is dissolved with
10 g of ethylene alcohol and
5 g of NaOH 36° Bé in
332 g of water at room temperature. There are then added
30 g of the fatty alcohol oxyethylation product,
18 g of the stabilised diazo salt,
500 g of the thickener solution and
100 g of the polyethylene glycol from Example 1.

The mixed fabric from Example 1 is printed with the above printing paste exactly in the manner described therein, and there is obtained an equally evenly printed mixed fabric having identically good fastness properties.

We claim:

1. In a process for the tone-in-tone printing and padyeing of textile material made from fiber mixtures of cellulose and at least one synthetic material from the group of polyamide, polyester and cellulose acetate with the use of solvents having swelling properties selected from the group of glycols and glycol derivatives which process comprises printing or impregnating the textile material with a printing paste or padding liquor, subsequently subjecting the printing or the dyeing, after intermediate drying, to a heat treatment and subjecting the resultant material to a finishing process, the improvement according to which the dyestuff contained in the printing paste or padding liquor is at least one disperse dyestuff said dyestuff being produced in the printing paste or padding liquor itself by reaction of a coupling component with a diazo component.

2. A process according to claim 1 wherein the coupling components used are acetoacetic acid amides or acetoacetic acid arylamides, pyrazoles, amino- and/or hydroxynaphthalenes, hydroxynaphthoic acid anilides or amines of the benzene or naphthalene series.

3. A process according to claim 1 wherein the coupling components used are hydroxypyridones.

4. A process according to claim 1 wherein the diazo components used are a diazotized substituted aniline, naphthylamine, diphenylamine or a heteroaromatic amine.

5. A process according to claim 1 wherein the diazo components used are a diazotized substituted diamine of the formula $H_2N\text{-}A\text{-}NH_2$, whereby A represents the phenylene, naphthylene or diphenyl group, or a group of the formula

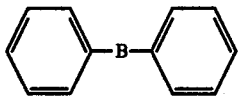

wherein B is oxygen, sulphur, —NH—, —$SO_2$—, —N=N—, —CH=CH—, —NHCO— or —NH—CO—NH—.

6. A process according to claim 1 wherein the textile material is polyester/cellulose.

7. A process according to claim 6 wherein the textile material is polyester/cotton.

8. A process according to claim 1 wherein the solvent having swelling properties is a polyglycol.

9. A process according to claim 8 wherein the polyglycol is polyethylene glycol.

10. A process according to claim 1 wherein the textile material impregnated with the printing paste or padding liquor is finished by heating at 210°-220° C. for 60 seconds, or by steaming with steam at 1.5 bars excess pressure for 15 to 30 minutes.

11. A process for the production of a printing paste or padding liquor, which comprises forming a disperse dye in the printing paste or padding liquor by mixing a coupling component with a pasting agent, dissolving this mixture in water, adding a thickening agent, and subsequently adding a diazo component and a solvent having swelling properties selected from the group of glycols and glycols derivatives, and hence coupling the coupling component with the diazo component to form a disperse dye.

12. A process according to claim 11 wherein the coupling component is dissolved in the presence of alkali.

13. A process according to claim 11 wherein the solvent having swelling properties is added to the printing paste or padding liquor before the addition of the diazo component.

14. A process according to claim 11 wherein the coupling components used are acetoacetic acid amides, acetoacetic acid arylamides, pyrazoles, aminonaphthalenes, hydroxy-naphthalenes, amino and hydroxy-naphthalenes, hydroxynaphthoic acid anilides or amines of the benzene or naphthalene series.

15. A process according to claim 11 wherein the coupling components used are hydroxypyridones.

16. A process according to claim 11 wherein the diazo components used are a diazotized substituted aniline, naphthylamine, diphenylamine or a heteroaromatic amine.

17. A process according to claim 11 wherein the diazo components used are a diazotized substituted diamine of the formula $H_2N$-A-$NH_2$, whereby A represents the phenylene, naphthylene or diphenyl group, or a group of the formula

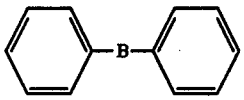

wherein B is oxygen, sulphur, —NH—, —$SO_2$—, —N=N—, —CH=CH—, —NHCO— or —NH-=CO—NH—.

18. A printing paste or padding liquor produced according to claim 11.

19. A process according to claim 11 wherein a dispersing agent is added to the said mixture dissolved in water.

* * * * *